United States Patent [19]

Thyvold

[11] 4,254,940

[45] Mar. 10, 1981

[54] WINCH

[76] Inventor: Olav Thyvold, 3004 Craigowan Rd., Victoria, British Columbia, Canada

[21] Appl. No.: 22,727

[22] Filed: Mar. 22, 1979

[51] Int. Cl.[3] ..... B66D 1/04

[52] U.S. Cl. ..... 254/341; 74/143; 74/812

[58] Field of Search ..... 254/150 R, 175.3, 175.5, 254/175.7, 186 HC, 187.1, 163, 164; 74/143, 812

[56] References Cited

U.S. PATENT DOCUMENTS

| | | | |
|---|---|---|---|
| 833,355 | 10/1906 | Veeder | 74/812 X |
| 1,089,483 | 3/1914 | Laffond | 74/812 |
| 1,827,597 | 10/1931 | Mellon | 254/186 HC X |
| 3,853,303 | 12/1974 | Wineburner | 254/150 R |
| 3,942,762 | 3/1976 | Reymond | 254/150 R |

*Primary Examiner*—John M. Jillions
*Attorney, Agent, or Firm*—Carver & Company

[57] ABSTRACT

A winch having a main frame on which a drum is rotatably mounted and which is unidirectionally driven by a drive shaft rotatably mounted in the frame, the drive shaft having a pair of axial gear rings rotatably mounted thereon and engageable in unidirectional driving engagement with the shaft, the gear rings meshing with the diametrically opposed pair of gear sectors which are oscillated by foot pedals attached thereto so that oscillatory motion of the gear sector results in unidirectional rotation of the drum.

3 Claims, 4 Drawing Figures

WINCH

BACKGROUND OF THE INVENTION

Prior Art

In winches used on sailing boats for handling sheets, or other lines, it is common to use a winch in which a lever, or the like, is inserted in top of the winch drum and, either directly or through reduction gears, can be operated to rotate the drum. This type of winch can, with difficulty, be operated by one man, however, for fast and efficient action two men are required, one to operate the winch handle and one to maintain the line in frictional engagement with the winch drum.

In larger sailing craft, types of winches called coffee-grinders or grinders, are quite often used. These types of winches are normally operated by two men who operate crank handles to rotate the winch drum which necessitates a third man to handle the sheets or levers.

Winches operable by leg power have in the past been developed, however, such winches have used rotatable bicycle-type pedal assemblies for motive power. This type of driving assembly has not been entirely successful as the bicycle-type drive results in dead spots where the crank arms are generally in line with the direction of thrust of the legs.

This type of winch, however, does leave a winch operator's hands free so that he can drive the winch with his legs and at the same time handle the line wrapped around the winch drum.

SUMMARY OF THE INVENTION

The present invention provides a leg-powered winch which leaves an operator's hands free so that he can operate the winch and line at the same time.

The winch of the present invention does not use a bicycle-type of operating mechanism, but uses an oscillating mechanism so as to avoid dead spots common to bicycle-type drives.

The present invention comprises a supporting frame, a drive shaft support for rotation of the frame, a winch drum mounted on the shaft for rotation therewith, a pair of ring drive members mounted in axially spaced apart relationship on the shaft for free rotation relative to the latter, a gear sector mounted for oscillatory movement on the frame between the gear ring drive members and in driving relationship with the latter, pedal means for oscillating the gear sector and one-way clutch means for automatically and alternately engaging the ring members in driving engagement with the shaft as the gear sector is oscillated for rotating the shaft and with the drum unidirectionally.

In another aspect of the invention, means are provided for selectively engaging, or disengaging, the shaft and drum for enabling the winch to be used as a power source for operating other equipment on a sailing boat, while at the same time rendering the drum immobile.

A detailed description following, related to the drawings, gives exemplification of apparatus according to the invention which, however, is capable of expression in means other than those particularly described and illusrated.

DETAILED DESCRIPTION

Figure 1:
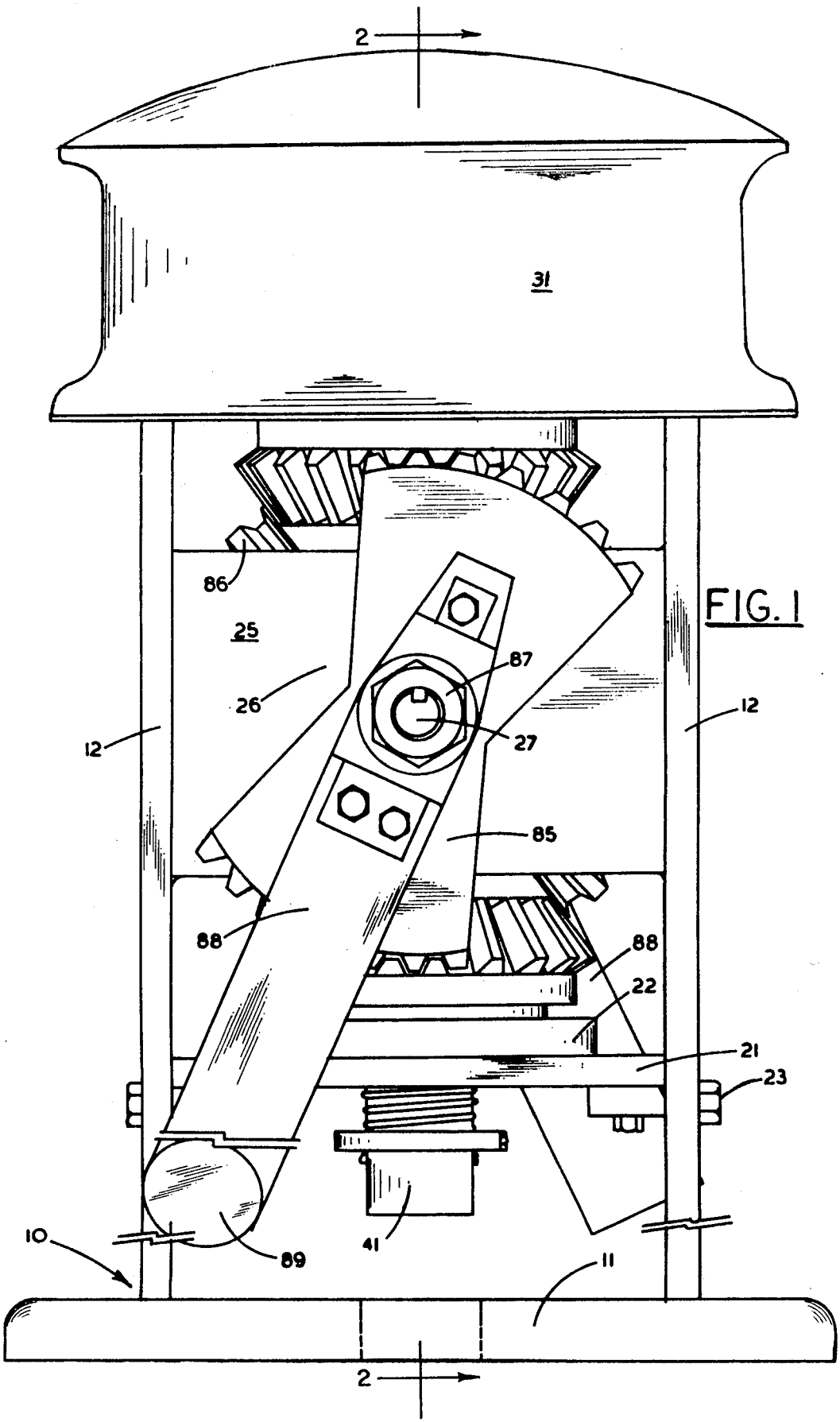
FIG. 1 is an elevation of the winch.
Figure 2:
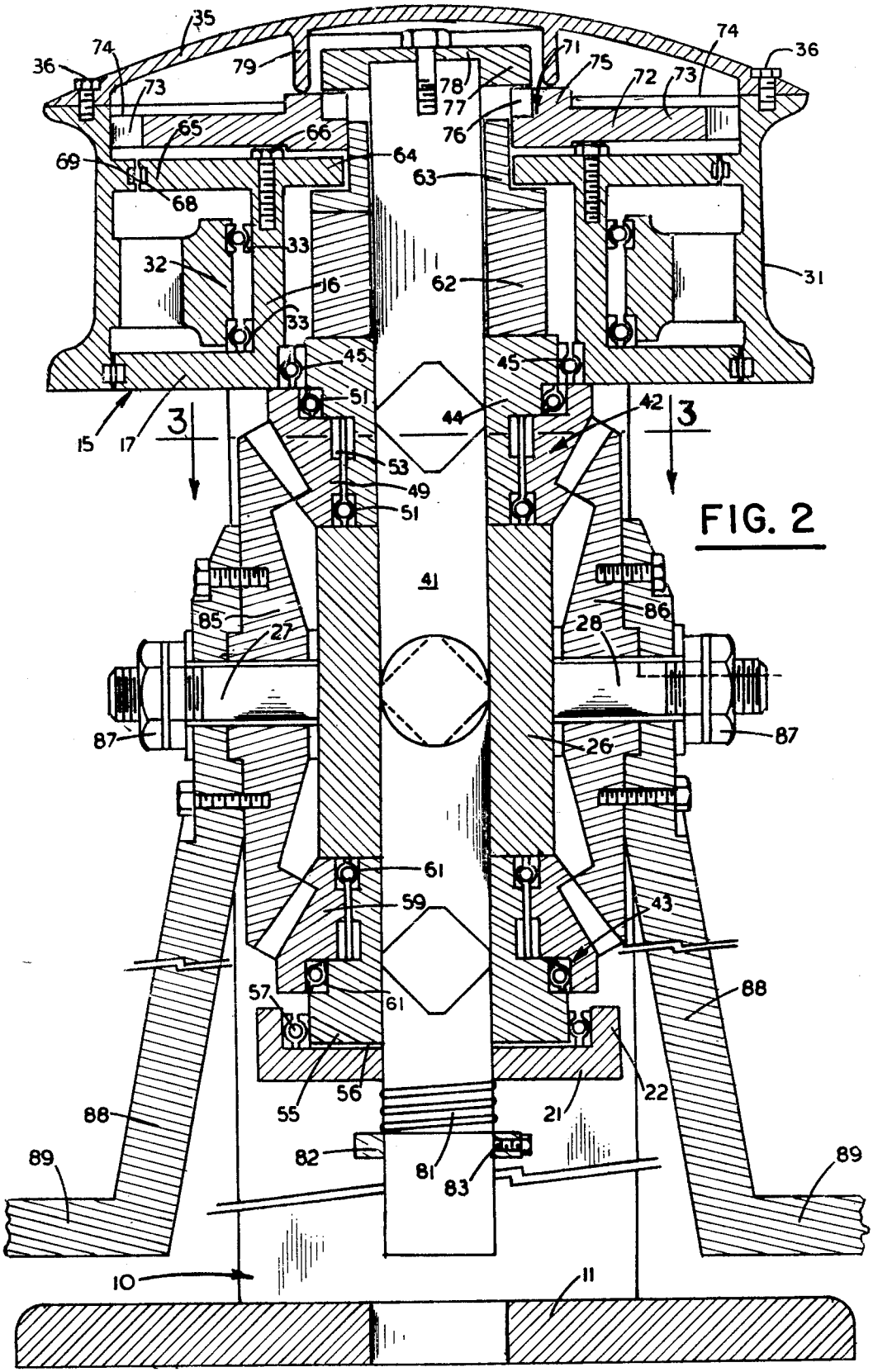
FIG. 2 is a central sectional view of the winch taken on Line 2—2 of FIG. 1.

Referring to the drawings, and in particular to FIGS. 1 and 2, the winch of the invention has a main frame 10 which includes a base plate 11 securable to a deck, or the like, from which a pair of spaced parallel upright stanchions 12—12 are mounted as by welding. An annular head 15 is secured at the upper ends of the stanchions, the annular head being of "L" shaped cross-section and having a cylindrical portion 16 and a radially extending annular flange portion 17. A cross brace 21 which carries an annular bearing seat 22 is secured by bolts 23 between the stanchions below the head. There is also provided a pair of cross braces 25—25 welded between the stanchions between the head and the cross brace 21 between which an annular block 26 is welded. A pair of diametrically opposed stub shafts 27 and 28 which are threaded at their upper ends extend laterally in diametrically opposed opposition from the block 26.

The main frame 10 supports a winch drum 31 for free rotation, the drum having an inwardly projecting annular member 32 upon which a pair of bearings 33 are mounted, providing bearing support from the drum on the cylindrical portion 16 of the annular head. The drum also has a removable cover plate 35 secured to the drum proper by bolts 36.

Figure 3:
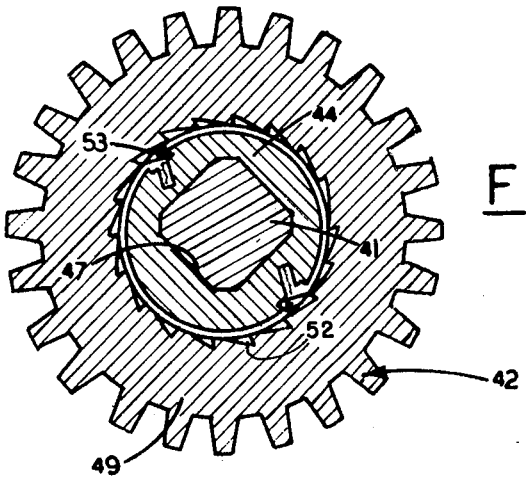
FIG. 3 is a sectional view of a gear ring and core, on Line 3—3 of FIG. 2.

A square cross-section drive shaft 41 is supported for rotation in the main frame by a pair of gear assemblies 42 and 43. Gear assembly 42 has a core 44 supported for rotation in the frame by bearings 45 and has a square central opening 47 within which the drive shaft has a slidable fit. A gear ring 49 is rotatably mounted on the core 44 by bearings 51 and has, see FIG. 3, internal ratchet teeth 52 which are engaged by pawls 53 mounted on the core. The pawl and ratchet teeth link the gear ring in driving engagement with the core for rotation in a clockwise direction.

The gear assembly 43, like the gear assembly 42, has a core 55 supported for rotation in the bearing seat 22 by a thrust washer 56 and bearings 57, and has a gear ring 59, similar to gear ring 49, rotatably supported thereon by bearings 61. Gear assembly 43 is also provided with a ratchet and pawl arrangement similar to gear assembly 42 to link the gear ring 49 in driving engagement with the core 55 for mutual rotation in a clockwise direction.

A spacer 62 encircles the shaft over the core 44 and supports a thrust washer 63 having an "L" shaped cross-section and which is also provided with a square opening for slidably receiving the shaft. The thrust washer is held on the spacer by the lip 64 of an annular plate 65 which is secured by bolts 66 to the upper end of the cylinder portion 16 of the annular head so as to become, in fact, part of the frame. The annular plate 65 is provided with a pawl 68 which engages ratchet teeth 69 formed internally of the drum and which is so directed as to prevent rotation of the drum relative to the frame in an anti-clockwise direction.

Figure 4:
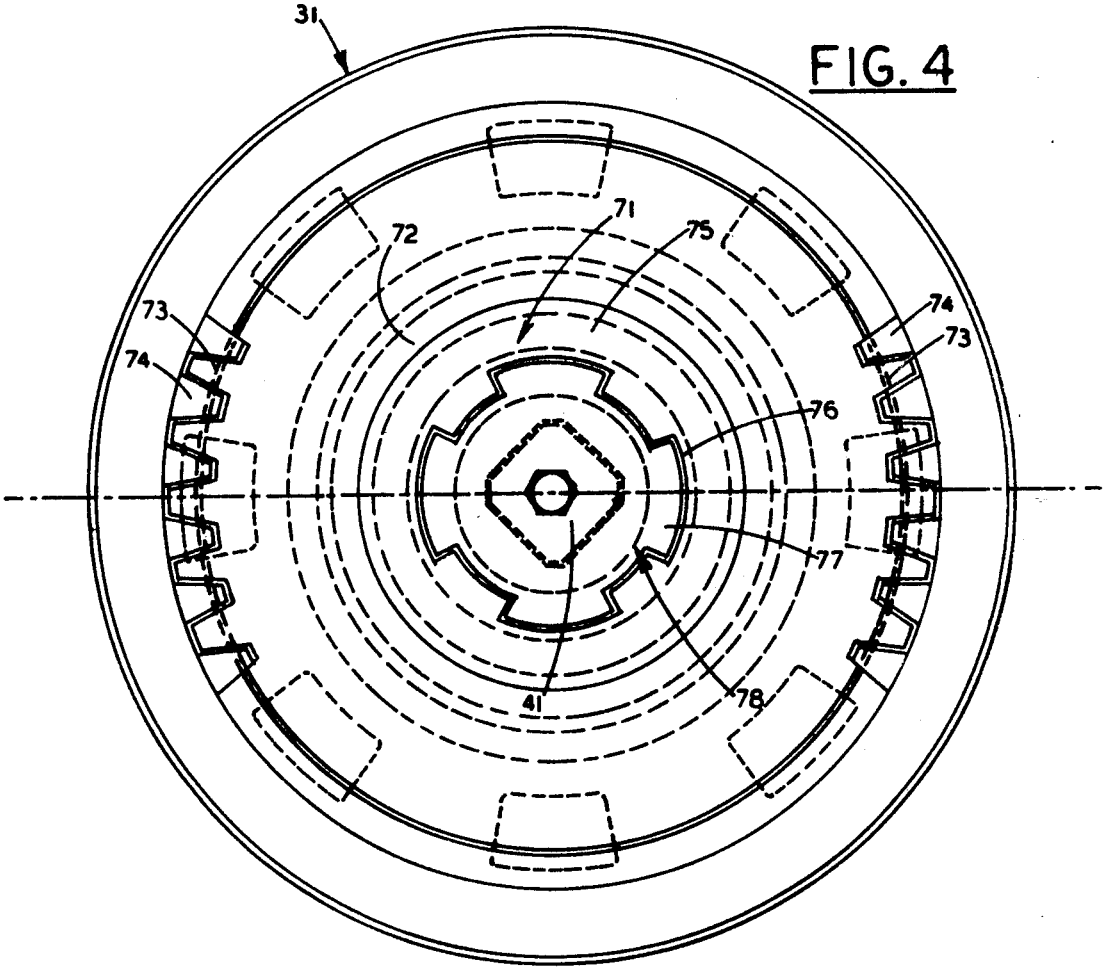
FIG. 4 is a plan view of a winch drum, with cover removed.

The drive shaft and drum are linked for mutual rotation by the operation of a dog-clutch assembly 71. The assembly 71, see also FIG. 4, has a driving arm 72 fitting over the thrust washer 63 and which has end teeth 73—73 which slidably mesh with co-operating teeth 74—74 formed in the drum. The driving arm also has a central hub portion 75 provided with notches 76 with which lugs 77 of a dog-clutch element 78, secured on the upper end of the shaft, mesh. As the shaft is vertically slidable, the clutch element can be moved into and out of sliding engagement with the driving arm so as to enable, selectively, the shaft to be disposed in or out of driving engagement with the drum. The cover plate has a depending centrally-located annulus 79 engaging the drive arm to prevent lifting of the latter when the shaft is lifted to disengage the dog-clutch. A coil spring 81 which fits under compression between the cross brace 21 and a ring 82 secured against longitudinal movement of the shaft by a set-screw 83 normally urges the shaft and with it the dog clutch element to an engaged position with the driving arm.

A pair of double-ended gear sectors 85 and 86 are rotatably mounted on the stub shafts 27 and 28, respectively, each of the sectors having gear teeth at opposite ends which mesh with the gear rings 49 and 59. The sectors are secured on their respective shafts by nuts 87 and have arms 88—88 of cranks bolted thereto. The cranks which depend from the gear sectors have pedals 89 to enable them to be foot-operated.

In operation, an individual can sit on one side of the winch with his feet on the pedals, with his hands free to handle a sheet, or line, which is wrapped around the drum. The cranks are pumped alternately to oscillate the gear sectors. Each gear ring will, due to its individual ratchet and pawl arrangement, alternately and intermittently rotate their respective cores in a clockwise direction which will, consequently, result in rotation of the drum in a clockwise direction.

With the arrangement above described, it is apparent that the winch can, without affecting disposition of a sheet which may be wrapped around the drum, be used as a power source for driving other equipment on a boat. The lower end of the shaft 41 can be a connection with the other equipment to be driven and, with the use of conventional clutch and thrust bearing mechanism, the shaft can be elevated to disengage the dog clutch assembly, thus resulting in disengagement of the shaft and the drum and thus enabling the shaft to be rotated by operating the pedals without affecting the drum, the latter remaining stationary by virtue of its own ratchet engagement with the frame.

I claim:

1. A winch comprising:

(a) an elongated supporting frame, (b) a drum mounted for unidirectional rotation on the frame, (c) a drive shaft rotatably supported by and extending longitudinally of the frame, (d) means for connecting the drive shaft and drum for mutual rotation, (e) a pair of gear rings rotatably mounted in the frame in spaced relationship over and rotatable relative to the shaft, (f) two manually operated gears mounted in diametrically opposed relationship relative to the shaft for oscillatory movement on the frame between and meshing with the gear rings for oscillating the latter, each manually operated gear having a crank for oscillating its associated gear and a pedal on the crank so the cranks can be pumped alternately by an operator's feet to oscillate the manually operated gears, and (g) locking means automatically operable for locking each gear ring and the drive shaft for mutual rotation when each gear ring is rotated in a direction required to obtain said unidirectional rotation of the drum.

2. A winch as claimed in claim 1 in which the locking means for connecting each gear ring and shaft comprises:

(a) a core element for each gear ring encircling and engaging the shaft for mutual rotation therewith, (b) bearing means for rotatably mounting each gear ring on a core, (c) each gear ring having internal ratchet teeth, (d) a pawl on each core for engaging the ratchet teeth of the gear ring mounted thereon.

3. A winch as claimed in claim 1 in which the means for connecting the drive shaft and the drum comprises a dog-clutch assembly having a first clutch element secured to the drum and a second clutch element secured to the shaft near one end thereof for movement into and out of driving engagement with the first clutch element when the shaft is moved longitudinally between selected positions and spring means mounted on the shaft and engaging the frame normally urging the shaft into driving engagement with the drum, an end of the shaft opposite the one end being adapted to drive other equipment when the dog-clutch elements are disengaged.

* * * * *